US005273508A

United States Patent [19]

Jones

[11] Patent Number: 5,273,508

[45] Date of Patent: Dec. 28, 1993

[54] METHOD AND APPARATUS FOR EXERCISING MUSCLES OF THE UPPER LEGS AND LOWER TORSO

[76] Inventor: Arthur A. Jones, 1155 NE. 77th St., Ocala, Fla. 32670

[21] Appl. No.: 913,430

[22] Filed: Jul. 15, 1992

Related U.S. Application Data

[60] Continuation-in-part of Ser. No. 666,219, Mar. 7, 1991, Pat. No. 5,171,200, which is a continuation-in-part of Ser. No. 422,905, Oct. 18, 1989, Pat. No. 5,005,830, which is a division of Ser. No. 236,367, Aug. 25, 1988, Pat. No. 4,902,009, which is a continuation-in-part of Ser. No. 60,679, Jun. 11, 1987, Pat. No. 4,836,536, and a continuation-in-part of Ser. No. 181,372, Apr. 14, 1988, Pat. No. 4,834,365, said Ser. No. 666,219, continuation-in-part of Ser. No. 637,618, is a division of Ser. No. 422,905, Oct. 18, 1989, Pat. No. 5,005,830, said Ser. No. 666,219, continuation-in-part of Ser. No. 361,055, Jun. 5, 1989, Pat. No. 5,007,634.

[51] Int. Cl.[5] ..... A63B 21/062; A63B 103/00

[52] U.S. Cl. ..... 482/136; 482/100; 482/98; 482/133; 482/142

[58] Field of Search ..... 482/92, 93, 94, 97, 482/98, 99, 100, 102, 101, 103, 133, 134, 135, 136, 137, 142

[56] References Cited

U.S. PATENT DOCUMENTS

| | | | |
|---|---|---|---|
| 1,621,477 | 3/1927 | Pilates | 482/135 |
| 3,012,776 | 12/1959 | Hotas | 482/94 |
| 4,169,589 | 10/1979 | McArthur | 482/101 |
| 4,511,137 | 4/1985 | Jones | 482/100 |
| 4,546,967 | 10/1985 | Kecala | 482/102 |
| 4,634,127 | 1/1987 | Rockwell | 482/102 |
| 4,884,801 | 12/1989 | Schnell | 482/97 |
| 5,141,483 | 8/1992 | Smith | 482/142 |

OTHER PUBLICATIONS

Brochure of Nautilus Sports/Medical Industries-4 pages.

*Primary Examiner*—Richard J. Apley
*Assistant Examiner*—Lynne A. Reichard
*Attorney, Agent, or Firm*—William E. Mouzavires

[57] ABSTRACT

Method and apparatus for exercising the muscles of the upper legs and lower torso wherein the exerciser is placed on his/her side in a generally horizontal position on a support including a movable portion which rotates about a vertical axis in response to forces generated by the exerciser. At least two vertically extending pads are secured to the movable support portion to receive the exerciser therebetween. The pads serve to position and retain the exerciser as well as to transmit forces from the exerciser to the movable support portion to rotate the same. A weight stack is connected to the rotatable support portion by a drive mechanism located below the support portion and connected to the bottom of a weight rod included in the weight stack. During the exercise, the movable support portion is rotated by the exerciser from a start position in one direction against the resistance of the weight stack and then returned to the start position whereupon the exercise is repeated. At least one of the pads is removable from the movable support portion, and in one embodiment, one of the pads has a recessed intermediate portion to accommodate portions of the exerciser's body.

18 Claims, 8 Drawing Sheets

METHOD AND APPARATUS FOR EXERCISING MUSCLES OF THE UPPER LEGS AND LOWER TORSO

RELATED APPLICATIONS

This application is a continuation in part of my prior co-pending U.S. application Ser. No. 07/666,219, filed Mar. 7, 1991 now U.S. Pat No. 5,171,200 and entitled METHOD AND APPARATUS FOR EXERCISING THE LUMBAR MUSCLES, which is a CIP of U.S. application Ser. No. 07/422,905 filed Oct. 18, 1989 now U.S. Pat No. 5,005,830, which is a division of U.S. application Ser. No. 07/236,367 filed Aug. 25, 1988 now U.S. Pat. No. 4,902,009, which is a CIP of U.S. application Ser. No. 07/060,679 filed Jun. 11, 1987 now U.S. Pat. No. 4,836,536 and a CIP of U.S. application Ser. No. 07/181,372 filed Apr. 14, 1988 now U.S. Pat. No. 4,834,365, and said 07/666,219 is a CIP of U.S. application Ser. No. 07/637,618 filed Jan. 4, 1991 now U.S. Pat. No. 5,092,590 which is a division of U.S. application Ser. No. 07/422,905 filed Oct. 18, 1989 now U.S. Pat. No. 5,005,830 and said 07/666,219 is a CIP of 07/361,055 filed Jun. 5, 1989 now U.S. Pat. No. 5,007,634.

BACKGROUND OF INVENTION

The present invention relates to methods and apparatus for exercising muscles of the upper legs and lower torso, such muscles being for example the glutes, hamstrings, lower back, hip flexors, and abdominals.

In the prior art there exists methods and apparatus for exercising the aforementioned muscles, however these machines for the most part require that the exerciser lie on his/her back or stomach or be seated in an upright position on a seat where he/she is restrained by belts and other devices. Some of these prior art machines and methods are uncomfortable because of the restraints imposed on the exerciser's body while others present a problem in gaining access to the machines. Indeed in some of these machines the restraining belts can "dig" into the user's body resulting in a most uncomfortable condition. Furthermore, with these prior art machines, the exerciser must overcome the body mass of the upper torso while performing the exercise with the result that the efficiency of the exercise is decreased.

OBJECTS OF THE INVENTION

It is an object of the present invention to provide novel and improved methods and apparatus for exercising muscles of the upper legs and lower torso and which will overcome the problems described above. Although the present invention is primarily concerned with exercising the glutes, hamstrings, lower back, abdominals and hip flexor muscles, the present invention may have applicability to other muscles groups.

A further object of the present invention is to provide novel and improved methods and apparatus for exercising muscles of the upper legs and lower torso in a safe and efficient manner. Included herein is the provision of such methods and apparatus in which the exerciser has relatively easy access to the exercise apparatus and moreover is not restrained by straps or other uncomfortable devices.

A further object of the present invention is to provide novel and improved methods and apparatus for exercising muscles of the upper legs and lower torso while the weight effect of the exerciser's torso mass is eliminated so as to increase the efficiency of the exercise with respect to the muscles intended to be exercised.

A further object of the present invention is to provide novel and improved apparatus for exercising muscles of the upper legs and lower torso and which may incorporate a weight stack in a highly compact and efficient manner which provides easy reach and avoids overhead cables to the weight stack. Included herein is a provision of such apparatus which may incorporate a compound weight stack in accordance with my prior invention disclosed in U.S. Pat. No. 4,834,365.

Another object of the present invention is to provide a novel method for exercising the glutes, hamstrings and lower back muscles; and a novel method for exercising the abdominals and hip flexor muscles.

SUMMARY OF INVENTION

In carrying out the present invention, the exerciser is placed on his/her side on a horizontal support including a movable portion which may be termed a "movement arm" rotatable about a vertical axis in response to forces generated by the exerciser. At least two generally vertically extending pads are secured to the movable support on opposite sides thereof to receive and position the exerciser and also to transmit forces from the exerciser's body portions to the movement arm. In one embodiment used to exercise the hip flexors and abdominal muscles, two pads are provided on one side of the movable support and one pad on the opposite side so that in the starting position, the exerciser's upper legs or thighs extend generally straight from or coplanar with the torso with one pad engaged on the front of the thighs above the knees, another pad engaged against the crease of the buttocks, and a third pad engaged behind the lower legs above the ankles. In performing the exercise, the exerciser moves from the starting position into a curled position where the thighs are moved towards the exerciser's chest or torso against a resistance, provided in the preferred embodiment, by a weight stack connected to the movable support. The exerciser then returns to the starting position while the weight stack descends, and then the exercise is repeated.

In exercising the hip extension muscles which include the glutes, hamstrings, and lower back muscles, only two vertically extending pads are employed and positioned such that in the start position, the exerciser is in a curled position with the thighs extending towards and at an angle to the torso and with one pad engaged on the front of the exerciser in the area of the pelvis and the other pad engaged against the back of the thighs just above the knees. To perform the exercise, the thighs are extended in a straight path from or coplanar with the torso against a resistance preferably a weight stack during which the movable support is rotated about the vertical axis. The exerciser then returns to the start position while the weight stack descends, and then the exercise is repeated as desired.

In one preferred embodiment such as in the machine for exercising the hip flexors and abdominal muscles, the pad which engages the front of the exerciser is provided with a recess to accommodate portions of the exerciser's body. In both embodiments, it is preferred that one or more of the vertically extending pads be removable to facilitate access into or exit from the machine. Furthermore in the preferred embodiment, a drive mechanism is placed below the level of the horizontal and movable supports and connected to the bottom of a vertical rod included in the weight stack. Other features and aspects of the invention will become apparent from the description below.

DRAWINGS

Other objects and advantages will become apparent from the following more detailed description taken in conjunction with the following drawings in which.

DETAILED DESCRIPTION

Figure 1:
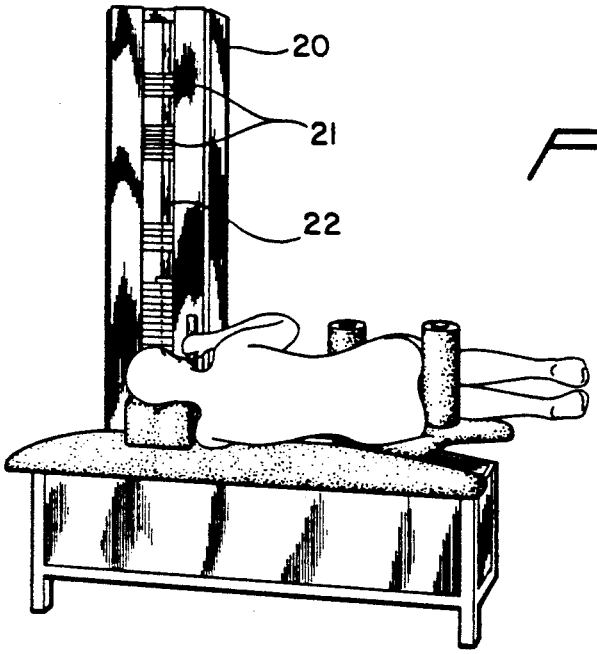
FIG. 1 is a pictorial view of a machine constituting one preferred embodiment of the present invention utilized for exercising the glutes, hamstrings, and lower back muscles, the machine being viewed from the front and with an exerciser shown in position on the machine.
Figure 2:
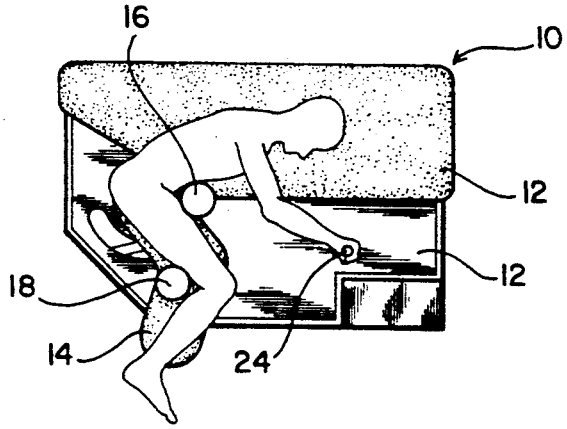
FIG. 2 is a diagrammatic plan view of the machine to a reduced scale and showing an exerciser in the start position of an exercise.
Figure 3:
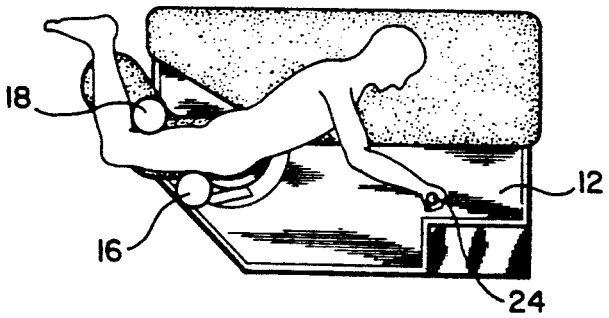
FIG. 3 is a view similar to FIG. 2 but showing the exerciser in a second position of the exercise where a movement arm has been rotated from the position shown in FIG. 2 to the position shown in FIG. 3.

Referring now to the drawings in detail, there is shown for illustrative purposes only methods and apparatus for exercising the muscles of the upper legs and lower torso in accordance with the present invention. FIGS. 1 through 6 disclose methods and apparatus for exercising the glutes, hamstrings and lower back muscles while FIGS. 7 through 12 disclose methods and apparatus for exercising the hip flexors and abdominal muscles. Referring first to FIGS. 1 through 6 inclusive, the method disclosed therein requires that the exerciser be placed on his/her side on a support surface as illustrated in FIGS. 1 through 3 and 6. In the preferred embodiment the support surface is generally designated 10 in FIG. 2 and includes a fixed portion 12 extending in a generally horizontal plane and a movable portion 14 extending in a generally horizontal plane generally coplanar with but slightly above fixed portion 12. Fixed portion 12 is suitably padded as is movable portion 14 and functions to support the exerciser's upper torso and head as shown in FIGS. 1 through 3. In addition a pad is fixed to portion 12 to support the head as best shown in FIG. 1.

Secured to and projecting generally vertically upwardly from movable support portion 14 are two pads designated 16 and 18. Pads 16 and 18 are arranged on movable support 14 and the latter is arranged relative to the fixed support 12 such that in the start position of an exercise as shown in FIGS. 1 and 2, one pad 16 is engaged by the front of the exerciser in the region of the pelvis while the other pad 18 is engaged by the backs of the thighs just above the knees as shown in FIG. 2. To perform the exercise, the exerciser rotates the movable support 14 about a generally vertical axis by exerting pressure with his body portions against the pads 16 and 18 to rotate the movable support 14 in a generally clockwise direction shown in FIGS. 2 and 3 from the position shown in FIG. 2 to the position shown in FIG. 3. Such movement is opposed by a resistance preferably a weight stack generally designated 20 in FIG. 1 having one or more weights 21 attached to a rod 22 which in turn is connected to the movable support 14 by a drive mechanism to be described below.

When moving from the start position shown in FIG. 2 to the rotated position of FIG. 3, one or more of the weights 21 together with the rod 22 are lifted, and when the exerciser returns to the start position shown in FIG. 2, the resistance weights and rod descend to their original position. The aforementioned sequence is repeated as may be desired and in doing so the forces generated by the exerciser against the pads 16 and 18 are derived from the glutes, hamstrings and lower back muscles which are thereby exercised. During the exercise, the exerciser grasps with his hands, a stationary support shown as a handle bar 24 fixed to the stationary support 12. During movement from the start position shown in FIG. 2 to the rotated position in FIG. 3, the exerciser rotates the movable support 14 sufficiently such that his upper legs extend from his torso in a generally straight path or coplanar with the torso as shown in FIG. 3. In the start position shown in FIG. 2, it will be seen that the upper legs are curled upwardly towards the torso and extend at an angle thereto. Accordingly the movable support 14 is mounted and arranged to allow such degree of rotation to perform the desired exercise.

It will be seen that because the exerciser is on his/her side during the exercise, the weight of the upper torso and legs acting vertically downwardly does not provide any moment about the vertical axis of the movable support 14, thus the weight of the torso and the legs acting vertically downwardly does not become involved in the exercise of the intended muscles thereby increasing efficiency of the exercise. It will further be seen that the pads 16 and 18 serve to position and restrain the exerciser during the exercise without requiring belts or other conventional restraints heretofore employed. In the preferred method and apparatus one of the vertical pads, preferably 18, is mounted in a passage provided in movable support 14 so that pad 18 may be removed from the support 14 to facilitate entry on to the machine in between the pads as well as exit from the machine.

Figure 4:
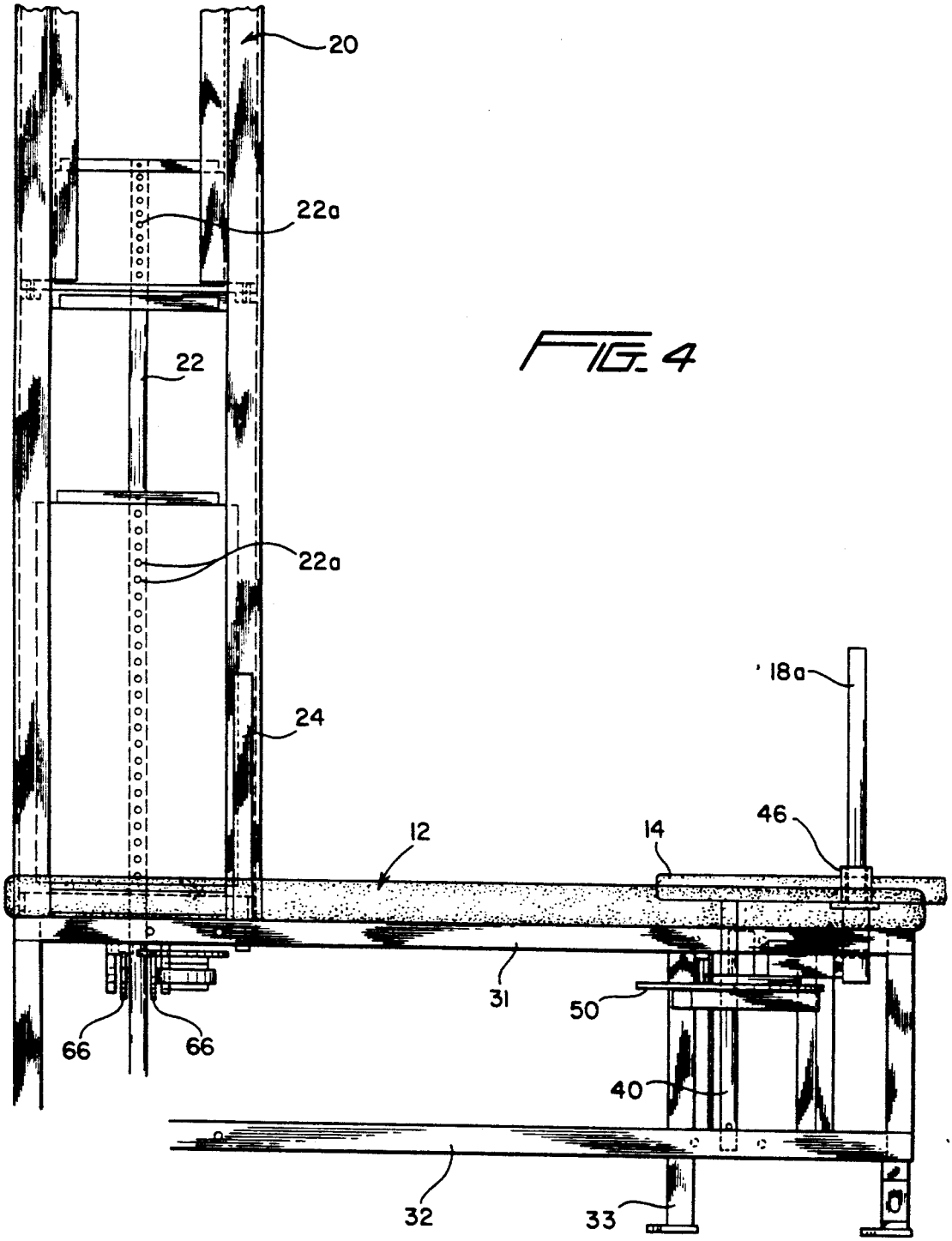
FIG. 4 is a front elevational view to an enlarged scale of the machine with certain parts removed for clarity.
Figure 5:
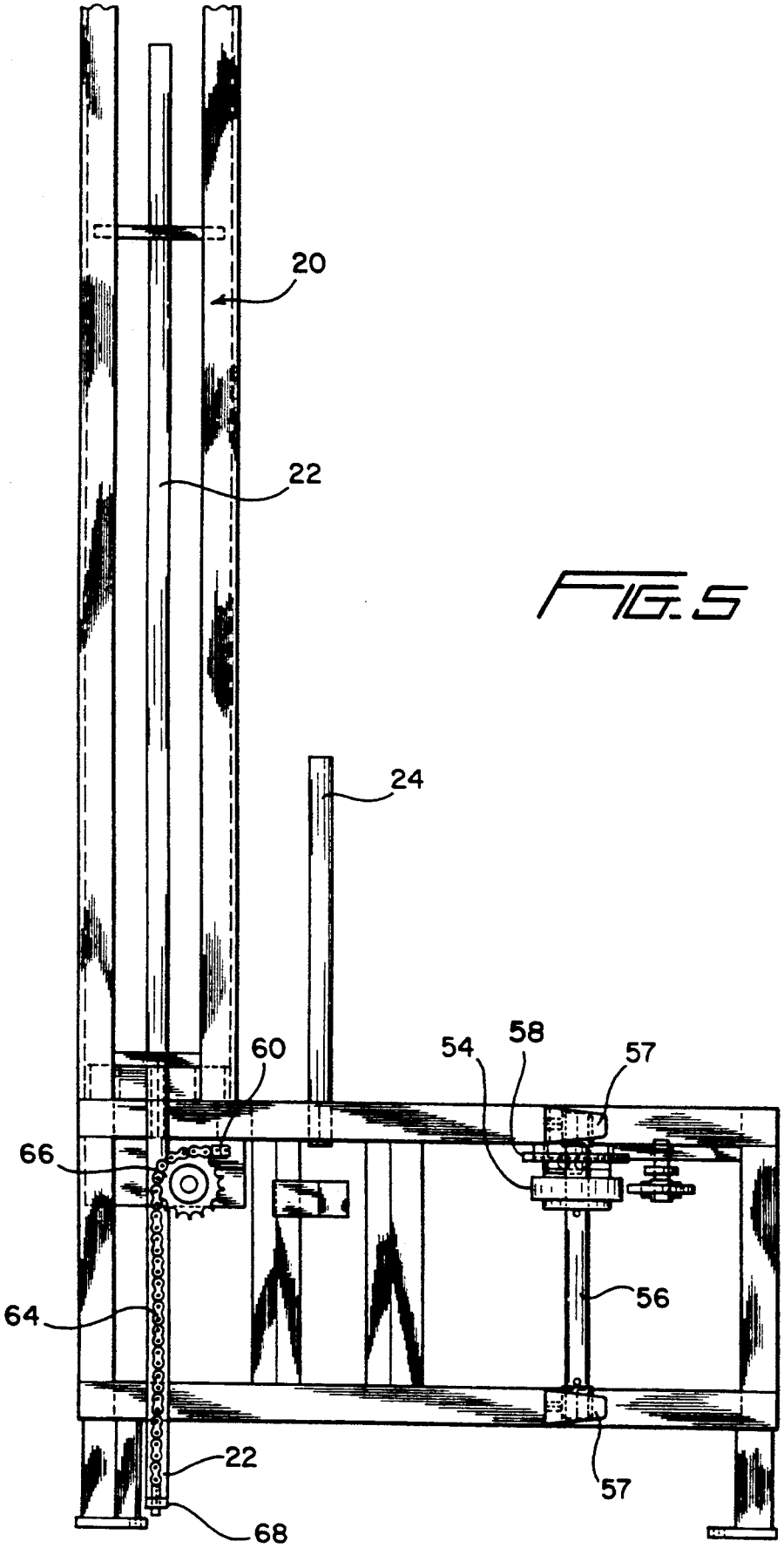
FIG. 5 is an end elevational view of the machine with parts removed for clarity.
Figure 6:
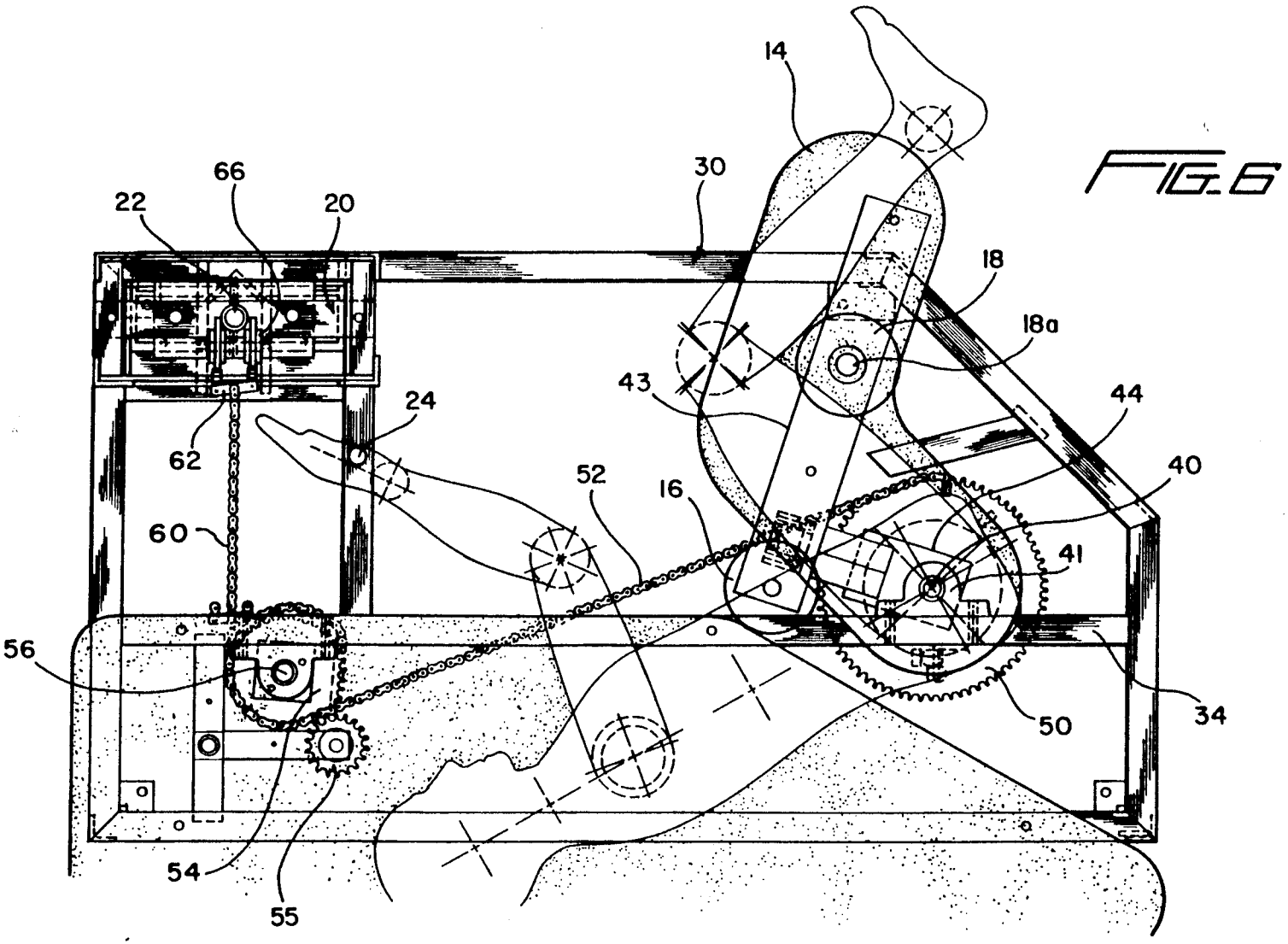
FIG. 6 is a plan view of the machine also illustrating in diagrammatic outline, an exerciser positioned on the machine in the start position of the exercise and wherein certain parts are removed for clarity.
Figure 7:
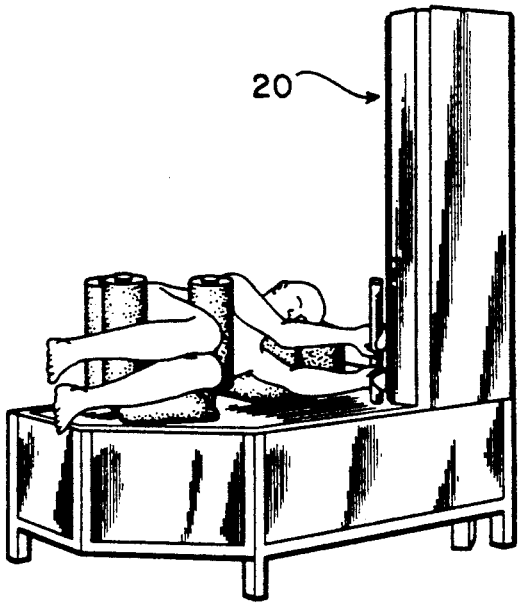
FIG. 7 is a pictorial view of a machine constituting another preferred embodiment of the invention utilized for exercising the hip flexor and abdominal muscles.
Figure 9:
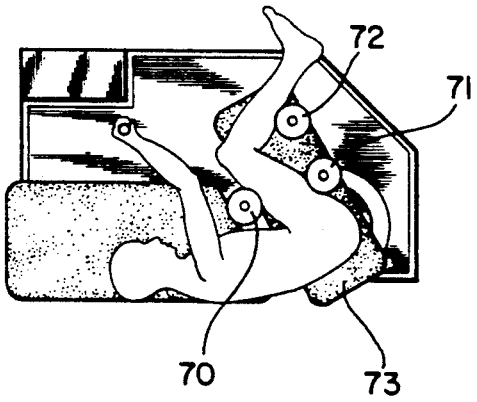
FIG. 9 is a view similar to FIG. 8 but showing the machine and the exerciser in a second position rotated from the position shown in FIG. 8.

Referring now to FIGS. 4, 5 and 6 there is disclosed a preferred apparatus or machine for carrying out the method described above. The machine includes a base frame generally designated 30 in FIG. 6 and which may be made from elongated structural steel or alloy channels or other members including an upper frame 31 to which is fixed the support 12, a lower frame 32 and vertical frame members 33 as best shown in FIGS. 4 and 5. Movable support 14 is mounted for rotation about a vertical axis provided by a vertical shaft 40 jounalled in the base frame 30 by means of blocks 41 fixed to intermediate frame portions 34 as shown in FIG. 6. In the preferred embodiment the movable support 14 includes a pad having a generally L-shape extending in a generally horizontal plane adjacent the fixed support 12 and a pair of arms 43 and 44 fixed to the underside of the pad 14 in an L-shaped configuration shown in FIG. 6 and with the arm 44 being mounted to the shaft 40 for rotation with the shaft. Vertical pad 18 is mounted for rotation about a support rod 18*a* which in turn is mounted in a sleeve 46 secured to arm 43 as best shown in FIGS. 4 and 6. Rod 18*a* is removable from sleeve 46 to remove the pad 18 to allow easy access to the machine and exit from the machine before and after exercise. The other vertical pad 16 is mounted to the arm 43 by means of a rod (not shown) similar to 18*a* but in this case it need not be made removable.

In order to transmit motion from the movable support 14 to the weight stack 20, a drive mechanism is provided below the horizontal supports 12, 14 within the frame 30. The drive mechanism includes a sprocket 50 suitably fixed for rotation to the sprocket shaft 40 and a sprocket chain 52 fixed at one end to the sprocket 50 and extending along a portion of the sprocket 50 and to a cam 54 located in the frame 30 at an end thereof opposite the end where the sprocket 50 is located as best shown in FIG. 6. The opposite end of chain 52 is trained about cam 54 with the end of the chain secured to cam 54. Cam 54 is mounted for rotation in a horizontal plane to a cam shaft 56 extending vertically in frame 30 and journalled for rotation therein by means of bearing blocks 57 as best shown in FIG. 5. Cam 54 is shaped to provide the desired leverage as the exercise proceeds. Above the cam 54 and below the frame 12, 31, a drive sprocket 58 is mounted for rotation to cam shaft 56 together with the cam 54 to which sprocket 58 is secured. As shown in FIG. 6, an idler sprocket 55 is mounted on an arm 59 secured to the frame 30 so that the chain 52 runs between the idler sprocket 50 and the cam 54.

Rotation of the weight drive sprocket 58 is transmitted to the resistance weight stack 20 by a chain 60 fixed at one end to the weight drive sprocket, trained about a portion of the weight drive sprocket and then horizontally extending to a yoke 62 as shown in FIG. 6 to which a pair of chains 64 are connected. Chains 64 are trained about a pair of redirectional sprockets 66 mounted for rotation in the frame about a horizontal axis below the support 12 and with the sprockets 66 in vertical planes on opposite sides of the weight stack rod 22 as best shown in FIGS. 5 and 6. Redirectional chains 64 after leaving redirectional sprockets 66 extend vertically downwardly on opposite sides of the weight stack rod 64 and at their bottom are connected to a yoke 68 which in turn is secured to the bottom of the weight stack rod 22 so as to lift the weight stack rod and any weights attached thereto when the redirectional chains 64 are raised in response to movement of the movable support 14 from the position shown in FIG. 2 to the position shown in FIG. 3. By this arrangement of the drive including the sprocket and chains, overhead pulleys above the weight stack are avoided to decrease the height of the weight stack and at the same time the drive mechanism is concealed and not exposed to contact by any persons in the area.

The weight stack 20 itself is preferably a compound weight stack as disclosed in my prior U.S. Pat. No. 4,834,365 whose disclosure is hereby incorporated by reference into the subject application and made part hereof. Such weight stack includes upper and lower stacks of weight plates 21 which may be connected to the rod 22 independently of the other. In the preferred embodiment disclosed in FIGS. 1 through 6, each weight plate of the upper weight stack is two pounds so that weight selection to provide the desired resistance may be made in two pound increments.

In use of the machine described above, assuming the desired resistance weight has been selected through use of the compound weight stack 20, the vertical pad 18 is removed from the support 14 and the exerciser accesses the machine on his/her side and then the pad 18 is inserted into position in the movable support 14 whereupon the exerciser assumes a position shown in FIG. 2 with the pad 16 engaging the front of the exerciser in the pelvic region and the pad 18 engaging the backs of the thighs above the knees. The exerciser grasps with his hands the support rod 24 whereupon he/she is ready to perform the exercise. In doing so the exerciser will apply pressure against the pads 16 and 18 to rotate the movable support 14 from the position shown in FIG. 2 to the position shown in FIG. 3 where the upper legs have been moved rearwardly of the exerciser to extend the upper legs from the torso in a generally straight path coplanar with the torso as shown in FIG. 3. During the latter phase, the weight stack will be raised in resistance to the exerciser after which the exerciser will return to the start position shown in FIG. 2 while the weight stack descends. The exercise is repeated as desired, and in performing this exercise, the glutes, hamstrings and lower back muscles will be contracted as the exerciser moves from the position shown in FIG. 2 to the position shown in FIG. 3 At the conclusion of the exercise the pad 16 is removed from support 14 to facilitate exit from the machine. The pad 16 is then returned to support 14.

In addition to the advantages provided by the present invention as described above, the present invention also positions the weight stack 20 in relatively close proximity to the exerciser while the exerciser is in position on the machine thus allowing the exerciser to change the resistance of the weight stack without requiring another person or exiting the machine.

Figure 8:
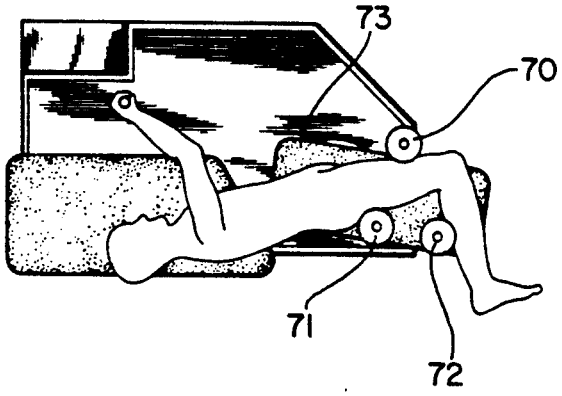
FIG. 8 is a diagrammatic plan view of the machine of FIG. 7 showing the exerciser in position at the start of an exercise.

Referring now to FIGS. 7 through 12 there is shown method and apparatus for exercising the abdominal and hip flexor muscles. In this method, the exerciser starts in an extended position shown in FIG. 8, that is with the upper legs extended from and generally coplanar with the torso, and moves to a curled position shown in FIGS. 7 and 9 against the resistance offered by the weight stack. In moving from the position shown in FIG. 8 to the position shown in FIG. 9, the exerciser contracts the hip flexors and abdominal muscles while working against the resistance provided by the weight stack. In this embodiment, three vertical pads, 70, 71 and 72 are employed on the movable support 73 which is arranged so that in the start position shown in FIG. 8, that is when the weight stack is in the lowered or normal position, the support 73 will be positioned such that the exerciser is between the pads 70, and 71, 72 with the upper legs extended along a straight path from the torso with the pad 70 engaging the front of the thighs above the knee, pad 71 the crease of the buttocks and pad 72 the back of the legs just above the ankles as shown in FIG. 8. To facilitate access and exit with respect to the machine, it is preferred that pads 71 and 72 both be made removable from the support 73. In moving the support 73 from the start position shown in FIG. 8 to the rotated position shown in FIG. 9, the exerciser will exert through the use of the hip flexors and abdominal muscles a force against the pad 70 to rotate the support 73 into the position shown in FIG. 9 wherein the exerciser's upper legs have been curled towards the torso. During the exercise the pads 70, 71 and 72 properly position and restrain the exerciser to insure that the desired muscles, i.e. the abdominals and the hip flexors are exercised.

Figure 10:
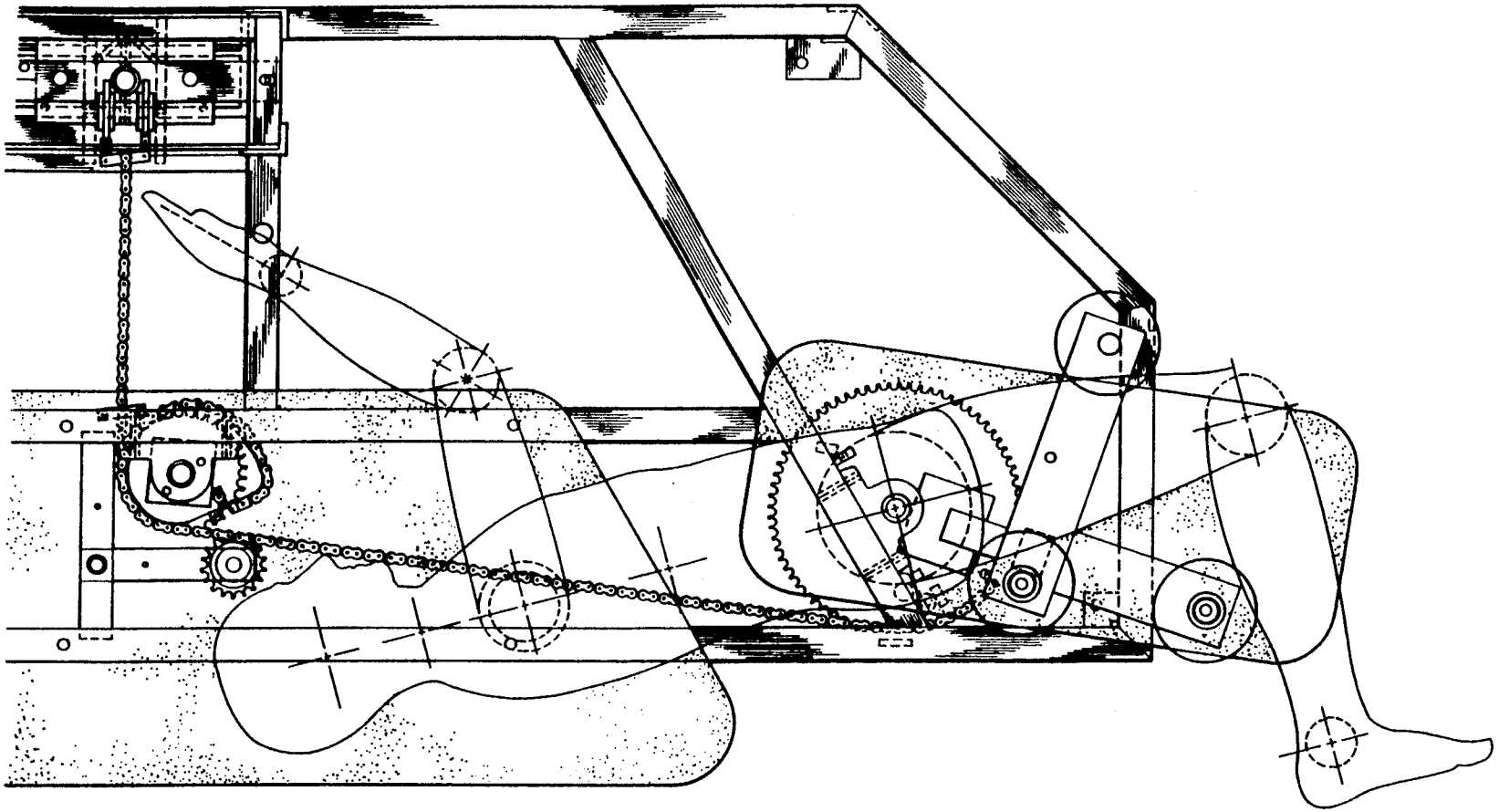
FIG. 10 is a plan view of the machine of FIG. 7 with parts removed shown in the start position and also showing in outline, an exerciser in position at the start of an exercise.
Figure 11:
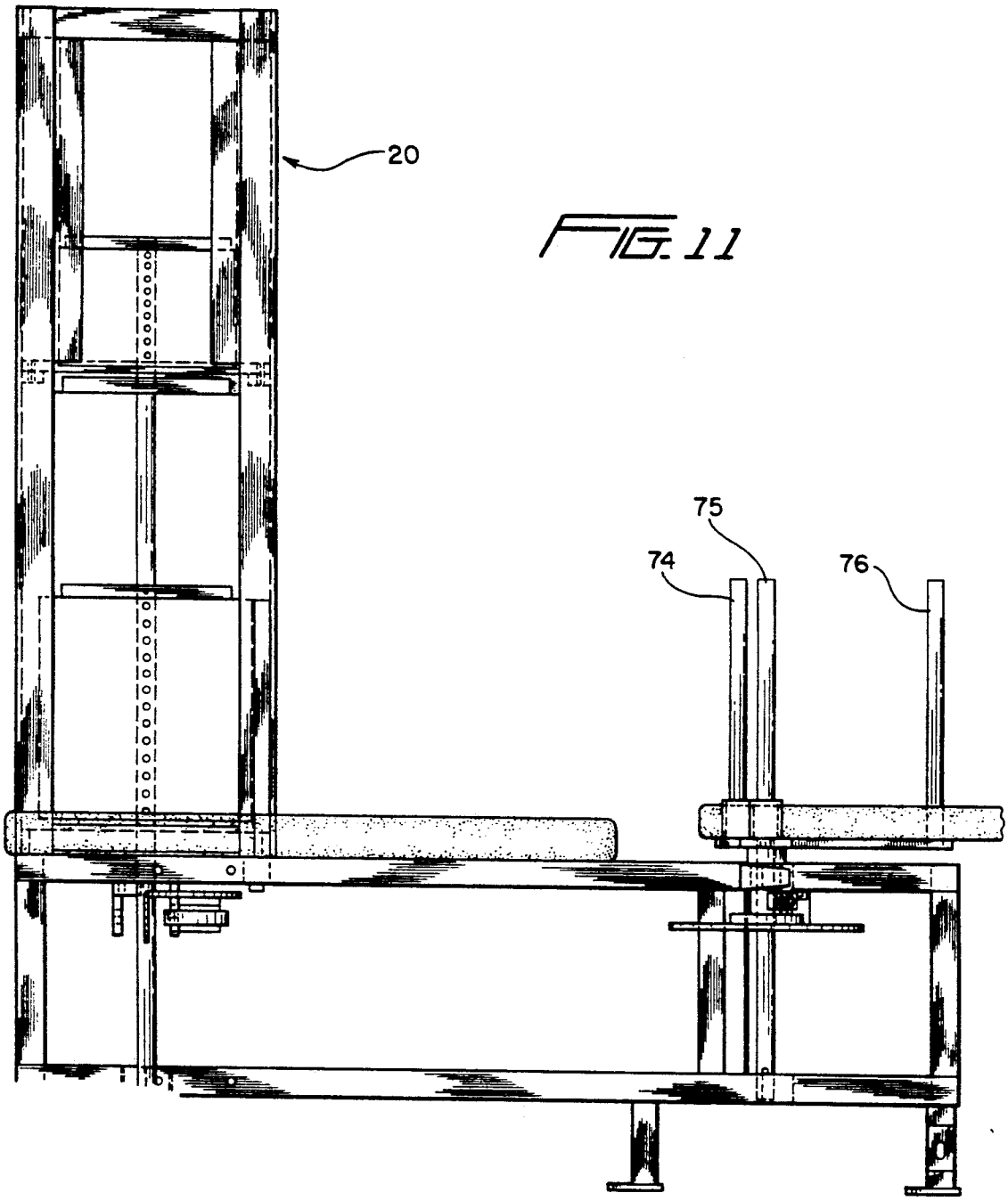
FIG. 11 is a front elevational view of the machine shown in FIGS. 7 through 10 with certain parts removed.
Figure 12:
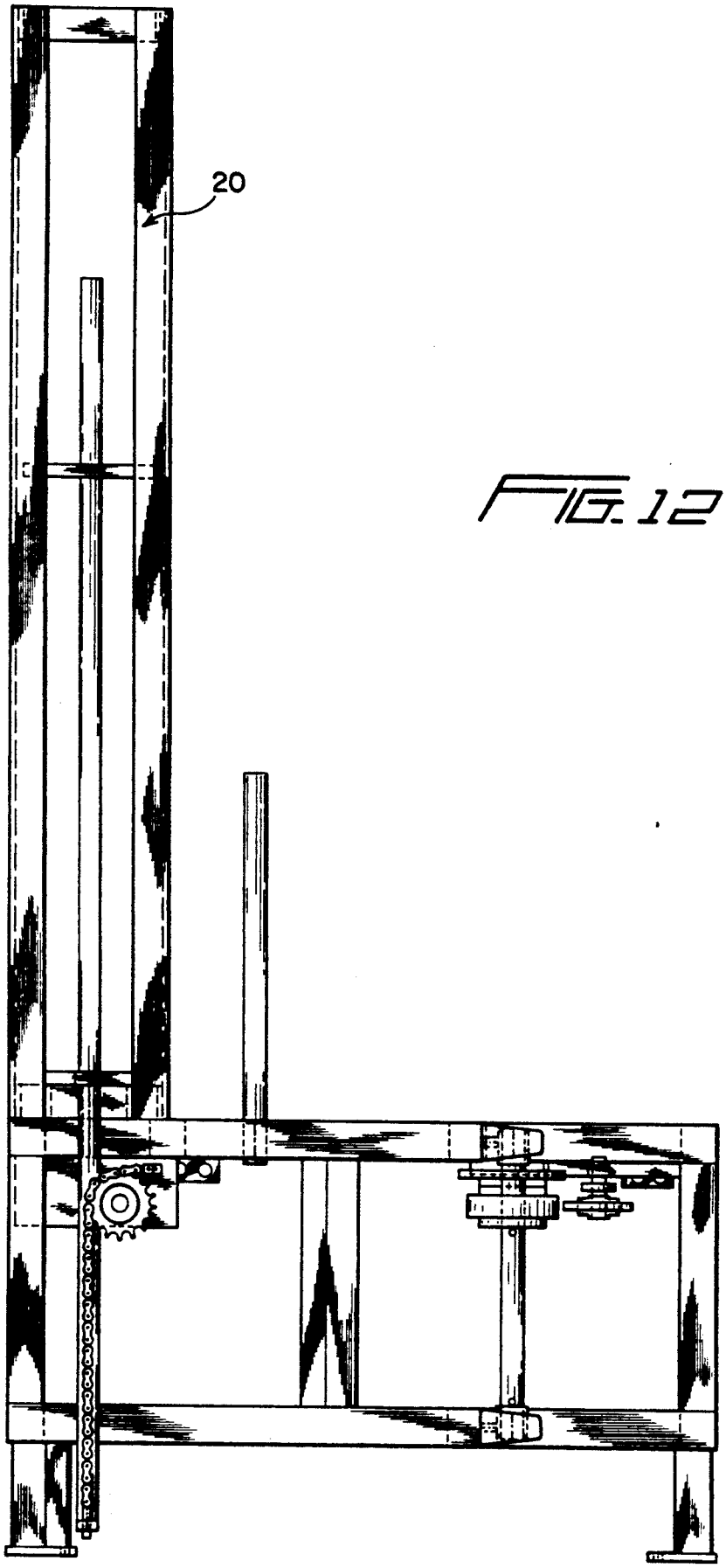
FIG. 12 is an end elevational view of the machine shown in FIGS. 7 through 11 and with certain parts removed.

The preferred embodiment of the machine disclosed in FIGS. 10, 11 and 12 may utilize the same or similar drive mechanism as that utilized in the machine disclosed in FIGS. 1 through 6 and described above. The same compound weight stack 20 may also be employed in the presently described embodiment. The main differences in the structure of the presently described machine are the use of three vertical pads and their positioning on the movable support 73. The positions of the movable support 73 in the start and rotated positions thereof are also different than and reverse to that of the machine disclosed in FIGS. 1 through 6. The rods which receive the vertical pads are shown in FIG. 11 as 74, 75 and 76. As disclosed above the pads are rotatable about the rods 74, 75 and 76.

In the preferred embodiments of both versions described above, the range of motion of the movement arm is about 120° with the maximum stroke of the resistance weights being about twelve inches.

Although the inventions have been shown and described above in connection with the exercise of certain muscles of the upper legs and lower torso, it will be appreciated that the inventions will have applicability to methods and apparatus used for exercising other muscle groups. Moreover, although preferred embodiments of the invention have been shown and described above, the inventions are not limited to these specific embodiments but rather the scope of the invention is indicated by the appended claims.

What is claimed is:

1. A machine for exercising muscles of the human body comprising in combination, a horizontal support including a fixed support portion and a movable support portion adapted to support an exerciser in generally horizontal position with one side of the exerciser engaging the support, means mounting the movable support portion for movement about a generally vertical axis in response to forces generated by the exerciser, a weight stack including a rod movable in a vertical direction and at least one resistance weight connectable to the rod, and drive means located below said support and being connected to the movable support portion and a lower end portion of the rod below said support for moving the rod upwardly when the movable support is rotated in one direction against the resistance offered by the weight and rod.

2. The machine defined in claim 1 wherein said drive means includes a first sprocket fixed to the movable support to be rotatable therewith, a cam horizontally spaced from said sprocket, a redirectional sprocket, and a chain or cable trained about said sprocket cam and redirectional sprocket and connected to said lower end portion of the rod, said sprockets, cam and cable or chain being located at a level below said horizontal support.

3. The machine defined in claim 1 further including at least two vertically extending pads secured to the movable support at spaced locations thereon for receiving portions of the exerciser's body therebetween, said vertically extending pads being movable as a unit with the movable support about said vertical axis.

4. The machine defined in claim 3 wherein one of said vertically extending pads is removable from said movable support portion to facilitate access thereto.

5. The machine defined in claim 3 wherein one of said vertically extending pads is positioned to be engaged by a front portion of the exerciser's body at the pelvis while the other vertically extending pad is positioned to be engaged by the back of the thighs of the exerciser.

6. The machine defined in claim 5 wherein said pad engageable by the front of the exerciser's body has a recess in an intermediate portion thereof for accommodating portions of the exerciser's body located between the legs thereof.

7. The machine defined in claim 3 including three vertically extending pads secured to the movable support for rotation therewith about said vertical axis, said vertically extending pads being spaced from each other with two pads being located to be engaged by the crease of the buttocks and the backs of the legs above the ankles respectively and the other pad being located to be engaged by the front of the thighs above the knees.

8. The machine defined in claim 1 further including a pair of pads secured to said movable support portion and extending generally vertically therefrom at spaced locations for receiving portions of an exerciser's body therebetween, one of said pads being located to engage the front of the exerciser's body at the pelvic area, and the other pad being located to engage the back of the thighs above the knees of the exerciser's body, said machine having a first normal position wherein the exerciser's thighs are curled about the first pad towards the exerciser's torso and a second position rotated from the first position wherein the exerciser's thighs are extended from the torso.

9. The machine defined in claim 8 wherein at least one of said pads is removable from the movement arm to facilitate access to the movement arm by the exerciser.

10. The machine defined in claim 8 wherein one of said pads has a recess located intermediate the ends thereof for accommodating portions of the exerciser's body.

11. A machine for exercising the hamstring, glutes and lower back muscles of the human body, the machine comprising in combination, a generally horizontal support including a fixed support portion and a movable support portion, said movable support portion being rotatable about a generally vertical axis in response to forces generated by said muscles, resistance means connected to said movable support portion to resist movement of said movable support portion in one direction about said axis, a pair of pads secured to said movable support portion and extending generally vertically therefrom at spaced locations for receiving portions of the exerciser's body there between, one of said pads being located to engage the front of the exerciser's body at the pelvic area, and the other pad being located to engage the back of the thighs above the knees of the exerciser's body, said machine having a first normal position wherein the exerciser's thighs are curled about the first pad towards the exerciser's torso and a second position rotated from the first position wherein the exerciser's thighs are extended from the torso.

12. The machine defined in claim 11 wherein said other pad is removably mounted to the movable support to facilitate access to the movable support by the exerciser.

13. The machine defined in claim 11 wherein said one pad has a recessed intermediate portion for accommodating portions of the exerciser's body between the legs thereof.

14. A machine for exercising the hip flexors and abdominal muscles of the human body, the machine comprising in combination a generally horizontal support including a fixed support portion and a movable support portion rotatable about a generally vertical axis, resistance means for opposing movement of the movable support portion between first and second positions spaced about said vertical axis, a plurality of vertically extending pads secured to the movable support at spaced locations to be rotatable with the movable support about said vertical axis, said pads including a first pad located to be engageable with the crease of the buttocks of the exerciser, a second pad located to be engageable with the backs of the legs above the ankle of the exerciser and a third pad located to be engageable with the front of the exerciser's body at the pelvis area, said movable support portion in the first position being such that the user's thighs are extended from the user's torso and in the second position the user's thighs are curled towards the torso.

15. A machine for exercising muscles of the lower torso and upper legs comprising in combination, a generally horizontal support including a fixed support portion and a movement arm rotatable about a generally vertical axis, resistance means for opposing movement of the movement arm between first and second positions spaced about said vertical axis, a plurality of vertically extending pads secured to the movement arm at spaced locations to be rotatable with the movement arm about said vertical axis, said pads including a first pad located to be engageable by the front of the exerciser's body at a location above the knees and a second pad located to be engageable with the back of the exerciser at a location above the knees, said movement arm being movable between a first position wherein the upper legs are curled towards the torso with the first pad being located therebetween and a second position wherein the upper legs extend from the torso in generally coplanar fashion.

16. The machine defined in claim 15 wherein at least one of said pads is removable from the movement arm to facilitate access to the movement arm by the exerciser.

17. The machine defined in claim 15 wherein one of said pads has a recess located intermediate of the ends thereof for accommodating portions of the exerciser's body.

18. The machine defined in claim 15 wherein said resistance means includes a weight stack having a vertical rod including a bottom located below the level of the movement arm, and drive means interconnecting the movement arm and the bottom of the rod for raising the rod when the movement arm is rotated by the exerciser in one direction about said axis.

* * * * *